US006062489A

United States Patent [19]

Tokumaru

[11] Patent Number: 6,062,489

[45] Date of Patent: May 16, 2000

[54] FUEL INJECTOR DEVICE FOR ENGINES

[75] Inventor: Takeshi Tokumaru, Fujisawa, Japan

[73] Assignee: Isuzu Motors Limited, Tokyo, Japan

[21] Appl. No.: 08/917,463

[22] Filed: Aug. 26, 1997

[30] Foreign Application Priority Data

Aug. 31, 1996 [JP] Japan ..... 8-249088

[51] Int. Cl.[7] ..... B05B 9/00; F02M 41/16; F02M 61/20

[52] U.S. Cl. ..... 239/124; 239/88; 239/90; 239/95; 239/96; 239/102.2; 239/533.9

[58] Field of Search ..... 239/88, 90, 91, 239/95, 96, 102.2, 124, 533.2, 533.9

[56] References Cited

U.S. PATENT DOCUMENTS

| | | | |
|---|---|---|---|
| 3,680,782 | 8/1972 | Monpetit et al. | 239/96 |
| 4,826,080 | 5/1989 | Ganser | 239/88 |
| 4,909,440 | 3/1990 | Mitsuyasu et al. | 239/533.9 X |
| 4,964,571 | 10/1990 | Taue et al. | 239/124 X |
| 5,199,641 | 4/1993 | Hohm et al. | 239/102.2 |
| 5,538,187 | 7/1996 | Mueller et al. | 239/533.9 X |
| 5,671,715 | 9/1997 | Tsuzuki | 239/96 X |
| 5,697,554 | 12/1997 | Auwaerter et al. | 239/88 |
| 5,779,149 | 7/1998 | Hayes, Jr. | 239/124 |

FOREIGN PATENT DOCUMENTS

| | | |
|---|---|---|
| 0331198 | 3/1989 | European Pat. Off. . |
| 2028442 | 12/1971 | Germany . |
| 4406901 | 9/1995 | Germany . |
| 61-244864 | 10/1986 | Japan . |
| 3-000965 | 1/1991 | Japan . |
| 4-171266 | 6/1992 | Japan . |

*Primary Examiner*—Andres Kashnikow
*Assistant Examiner*—Robin O. Evans
*Attorney, Agent, or Firm*—Browdy and Neimark

[57] ABSTRACT

The fuel injection device of this invention utilizes the fuel pressure in the balance chamber for closing the open-close valve to prevent fuel leakage from the open-close portion. When the open-close valve is opened, the valve stem of the open-close valve piercing through the exhaust passage in the control member moves toward the balance chamber. The valve head opens the port of the exhaust passage on the balance chamber side to lower the fuel pressure in the balance chamber, with the result that the needle valve lifts injecting the fuel. When the open-close valve is closed by the return spring, the fuel pressure in the balance chamber acts on the valve head to urge the open-close valve in the valve closing direction, preventing the leakage of fuel through the open-close valve.

7 Claims, 8 Drawing Sheets

FUEL INJECTOR DEVICE FOR ENGINES

BACKGROUND OF THE INVENTION

1. Field of the Invention

The present invention relates to a fuel injection device applied to engines such as diesel engines or direct injection type gasoline engines.

2. Description of the Prior Art

Conventional fuel injection devices that control fuel injection into combustion chambers of engines such as diesel engines include those disclosed in Japanese Patent Laid-Open Nos. 965/1991 and 171266/1992. These fuel injection devices have a needle valve that opens or closes nozzle holes formed at the front end of an injection nozzle and control the fuel injection by the balance between a force produced by a fuel pressure acting on the needle valve on the nozzle front side in a direction that opens the nozzle holes and a force produced by a fuel pressure in a balance chamber acting in a direction that closes the needle valve.

The fuel injection device of a type disclosed in the Japanese Patent Laid-Open No. 171266/1992 uses a three-way valve to open and close an exhaust passage that releases the fuel pressure in the balance chamber. As shown in FIG. 8 and 9, the three-way valve 54 of the fuel injection device electromagnetically switches, according to a control signal from a control unit, between a balance chamber passage 51 communicating with the balance chamber, a supply passage 52 connecting to a fuel supply pump through a common rail, and an exhaust passage 53 leading to a reservoir and thereby controls the start and stop of fuel injection.

As shown in FIG. 8, when the three-way valve 54 connects the supply passage 52 to the balance chamber passage 51 and closes the exhaust passage 53, the balance chamber recovers a high fuel pressure causing the needle valve to move down to stop fuel injection.

As shown in FIG. 9, when the three-way valve 54 operates to connect the balance chamber to the exhaust passage 53 through the balance chamber passage 51 and at the same time closes the supply passage 52, the high pressure fuel in the balance chamber leaks into the exhaust passage 53 through the balance chamber passage 51 and the balance chamber pressure decreases allowing the needle valve, whose end is exposed to the balance chamber, to lift to inject fuel through the open nozzle holes. The closure of the supply passage 52 blocks the high fuel pressure from entering into the balance chamber.

A fuel injection device of a type disclosed in Japanese Patent Laid-Open No. 965/1991 on the other hand uses a two-way valve for opening and closing an exhaust passage 65 that releases the fuel pressure from the balance chamber 62, as shown in FIG. 10. The balance chamber 62 is formed in a fuel injection device body 61 above a control piston 60 connected to the needle valve. The balance chamber 62 communicates with a supply passage 63 through which fuel is supplied from a fuel source and in which a throttle 64 is formed. The exhaust passage 65 for discharging fuel from the balance chamber 62 comprises a fuel passage 66 and an orifice 67. The orifice 67 is opened and closed by a solenoid valve 68 driven by a control signal from the control unit.

When the orifice 67 is opened by the solenoid valve 68, the fuel is released through the exhaust passage 65. Because the supply of fuel from the supply passage 63 is limited by the throttle 64, the fuel pressure in the balance chamber 62 decreases, causing the control piston 60 and therefore the needle valve to lift to inject fuel. When the orifice 67 is closed by the solenoid valve 68, the discharge of fuel from the exhaust passage 65 is stopped. As the fuel is supplied through the supply passage 63 and throttle 64, the fuel pressure in the balance chamber 62 recovers pushing down the control piston 60 and therefore the needle valve to stop fuel injection.

Another example of the fuel injection device, disclosed in Japanese Patent Laid-Open No. 244864/1986, uses a ball valve 73 having a stem passing through an exhaust passage 71 to open and close the exhaust passage 71 that releases the fuel pressure from a balance chamber 70, as shown in FIG. 11. The ball valve 73 works as a three-way valve that opens and closes fuel passages 76, 77 and the exhaust passage 71 by opening and closing ports 78, 79. FIG. 11 shows a state in which an actuator 74 of the solenoid valve is operated to push out the valve stem 72 to close the fuel passage 76 that branches from a fuel passage 75 communicating with a high pressure fuel source. When the ball valve 73 closes the port 79 of the fuel passage 76, the balance chamber 70 to which the end of the needle valve 80 is exposed communicates with the exhaust passage 71. The fuel pressure in the balance chamber 70 is then released into the exhaust passage 71 and the fuel pressure acting on a pressure receiving surface 82 of the needle valve 80 lifts the needle valve 80, injecting fuel from nozzle holes 81. When the actuator 74 is deenergized and the ball valve 73 closes the port 78 of the exhaust passage 71, the pressure of the fuel passage 76 is transmitted through the fuel passage 77 to the balance chamber 70, pushing down the needle valve 80 to stop fuel injection from the nozzle holes 81.

The fuel injection device of a type disclosed in Japanease Patent Laid-Open No. 171266/1992 such as shown in FIG. 8 and 9, however, has the drawback that although fuel seems to be not wasted because the three-way valve that opens and closes the exhaust passage closes the supply passage communicating with the balance chamber, the high pressure fuel actually leaks through a sliding clearance in the three-way valve, resulting in lower fuel efficiency than in the two-way valve. When, as shown in FIG. 8, the valve member 56 of the solenoid valve lowers relative to the valve shaft 55 to allow communication between the balance chamber passage 51 and the supply passage 52 through an open seal portion 58 and close the exhaust passage 53, which leads to the reservoir, with respect to the balance chamber passage 51 and the supply passage 52 by a seal portion 57, it is found that the high fuel pressure from the supply passage 52 leaks through a sliding clearance 59 between the solenoid valve body 56 and the fuel injection device body. It is also found that when, as shown in FIG. 9, the solenoid valve disc 56 moves up allowing communication between the balance chamber passage 51 and the exhaust passage 53 through the open seal portion 57 and closing the supply passage 52 by the valve shaft 55 at the seal portion 58, the high pressure fuel from the supply passage 52 leaks through the sliding clearance 59 between the solenoid valve member 56 and the fuel injection device body.

In the fuel injection device of a type disclosed in Japanease Patent Laid-Open No. 965/1991 shown in FIG. 10, the opening and closing of the exhaust passage 65 connected to the balance chamber 62 is controlled by the solenoid valve 68 as a two-way valve, which presses against the end of the exhaust passage 65 from outside to keep the fuel in the balance chamber 62. So, the solenoid valve 68 is always acted upon by a fuel pressure in a valve opening direction. Under this condition when it is attempted to inject the fuel at high pressure, the solenoid valve 68 is opened by the high fuel pressure which then leaks through the solenoid valve even while the fuel injection is not performed. The fuel leakage constitutes a wasted work of the fuel injection pump, degrading the mileage.

To prevent the solenoid valve from being opened by the fuel pressure requires increasing the force of a return spring of the solenoid valve. This unavoidably increases the size of the actuator (solenoid) that opens the solenoid valve against the force of the spring, which in turn poses such problems as increased manufacturing cost, increased power supplied to the solenoid of the actuator to drive the solenoid valve against the strong spring force, and increased size of the fuel injection device itself. Further, because the valve seat portion of the solenoid valve is formed around the port of the exhaust passage, the area of the valve seat portion is small, so that when the valve is closed a high surface pressure is produced at the valve seat portion by the impact of the valve disc of the solenoid valve caused by the strong spring force. The valve seat portion is therefore easily worn, which in turn causes fuel leakage from the worn seat increasing the overall leakage.

In the fuel injection device of a type disclosed in Japanese Patent Laid-Open No. 244864/1986 shown in FIG. 11, because the valve disc that opens and closes the exhaust passage is a ball valve 73, the seal portion where the ball valve 73 closes the exhaust passage 71 has a line contact, which means that the pressure acting on the seal portion is very high. This unavoidably wears the seal portion and causes fuel leakage through the worn part. Further, a turbulent flow of fuel generated around the ball valve 73 when it is activated causes the ball valve to vibrate, making the lift adjustment of the valve member and the fuel injection rate control impossible.

In the conventional fuel injection devices for engines, as described above, neither the three-way valve nor the two-way valve, both used to open and close the exhaust passage that releases the fuel pressure in the balance chamber, can prevent fuel leakage through these valves. As a result the fuel pump is burdened with wasted work, deteriorating the mileage.

SUMMARY OF THE INVENTION

An object of this invention is to solve the above-mentioned problems and to provide a fuel injection device for engines, in which an open-close valve is operated to open an exhaust passage to release the fuel pressure supplied into the balance chamber through a supply passage to control the lift of a needle valve, whose pressure receiving surface is exposed to the balance chamber, and thereby inject fuel from the nozzle holes when the needle valve is lifted and in which when the open-close valve is closed, the fuel pressure in the balance chamber is used for closing the valve to prevent leakage of fuel through the open-close valve.

The fuel injection device for engines according to this invention comprises: a device body having nozzle holes for injecting fuel; a needle valve reciprocating in a hollow portion in the device body to open and close the nozzle holes at one end thereof; a balance chamber in which is exposed the other end of the needle valve that forms a pressure receiving surface to receive a fuel pressure to control the lift of the needle valve; a supply passage to supply the fuel pressure to the balance chamber; an exhaust passage to release the fuel pressure from the balance chamber; an open-close valve to open and close the exhaust passage; and an actuator to drive the open-close valve; wherein the open-close valve comprises a valve stem piercing through the exhaust passage and extending into the balance chamber and a valve head provided at an end of the valve stem, and the valve head has a valve face that, when the valve is closed, contacts a valve seat formed at an inlet port of the exhaust passage.

In this fuel injection device, when the exhaust passage is closed by the open-close valve, the valve head of the open-close valve moves toward the outlet of the exhaust passage together with the valve stem that pieces through the exhaust passage and extends into the balance chamber. The valve face therefore is pressed against the valve seat, closing the exhaust passage. The valve face engages the valve seat through a surface contact. At this time, the fuel pressure in the balance chamber acts on the valve head to close the open-close valve. The higher the fuel pressure in the balance chamber, the greater the force acting to close the open-close valve. Hence, a resulting force to close the open-close valve against the valve seat is large enough to prevent leakage of fuel through the open-close valve, eliminating an unwanted burden on the fuel pump and thus improving the mileage.

Because the valve face engages the valve seat through a surface contact, it is possible to set the surface pressure on the valve seat to an appropriate value. This prevents wear of the valve seat that is caused by an excessively high pressure acting on a narrow area of the valve seat as when the valve engages the valve seat through a line contact in the conventional fuel injection devices.

The balance chamber can be formed by a hole in a control member constituting a part of the device body and by the other end of the needle valve. It is also possible to form the exhaust passage in the control member. With this construction, the supply and release of the fuel pressure for the control of the needle valve operation can be concentrated in a control block, which contributes to a simplified construction of a component of the fuel injection device, facilitating manufacture and assembly.

A return spring to urge the needle valve in a direction that closes the nozzle holes is accommodated in the balance chamber. The return spring engages at one end with the hole in the control member and at the other with the other end of the needle valve. This construction allows the space in the balance chamber to be used for accommodating the return spring, contributing to a reduction in the size of the fuel injection device. The return spring can be either a coned disc spring or a coil spring.

A part that has the nozzle holes and accommodates the needle valve reciprocatingly movable therein is taken as a nozzle body, and the nozzle body is connected to the control member to make them a part of the device body. A fuel passage and a groove leading to the hole may be cut in an engagement surface of the control member that contacts the nozzle body, so that when the body of the fuel injection device is assembled, the supply passage can be formed by using an engagement face of the mating component.

The open-close valve is formed of a poppet valve whose valve face is a convex tapered surface which, when the open-close valve is closed, is brought into close contact with a concave tapered surface of the valve seat. Since the convex tapered surface of the valve face is guided along and fits in the concave tapered surface of the valve seat, the operation of the open-close valve can be stabilized assuring reliable closure of the valve. If a turbulent flow of fuel should occur during the operation of the open-close valve, this valve guide ensures smooth and quick valve operation. Further, because the valve closing provides contact between the tapered surfaces, it is possible to provide a necessary hermetic contact area and pressure between the valve face and the valve seat to secure a sufficient seal.

The actuator can be formed of a piezoelectric element. The piezoelectric element has good responsiveness to the voltage application and deenergization and the resulting distortion generation and elimination. Even in very short fuel injection cycles corresponding to high revolution speed of engine, the start and stop of fuel injection can be performed quickly without little delay.

Further, the effective opening area at a port of the exhaust passage opened by the open-close valve is smaller than the minimum cross-sectional area of the exhaust passage. Therefore, the fuel pressure released from the balance chamber can be changed by changing the opening degree of the open-close valve. Because the operation mode of the open-close valve can be changed by changing the application timing, duration and magnitude of an electric current applied to the piezoelectric element, it is possible to change the lift speed of the needle valve according to the operating condition of the engine to produce various injection rate characteristics, particularly a stable, initial injection rate characteristic, thereby reducing the NOx emissions and noise level of the engine.

DETAILED DESCRIPTION OF THE EMBODIMENT

Now, embodiments of this invention will be described by referring to the accompanying drawings.

Figure 1:
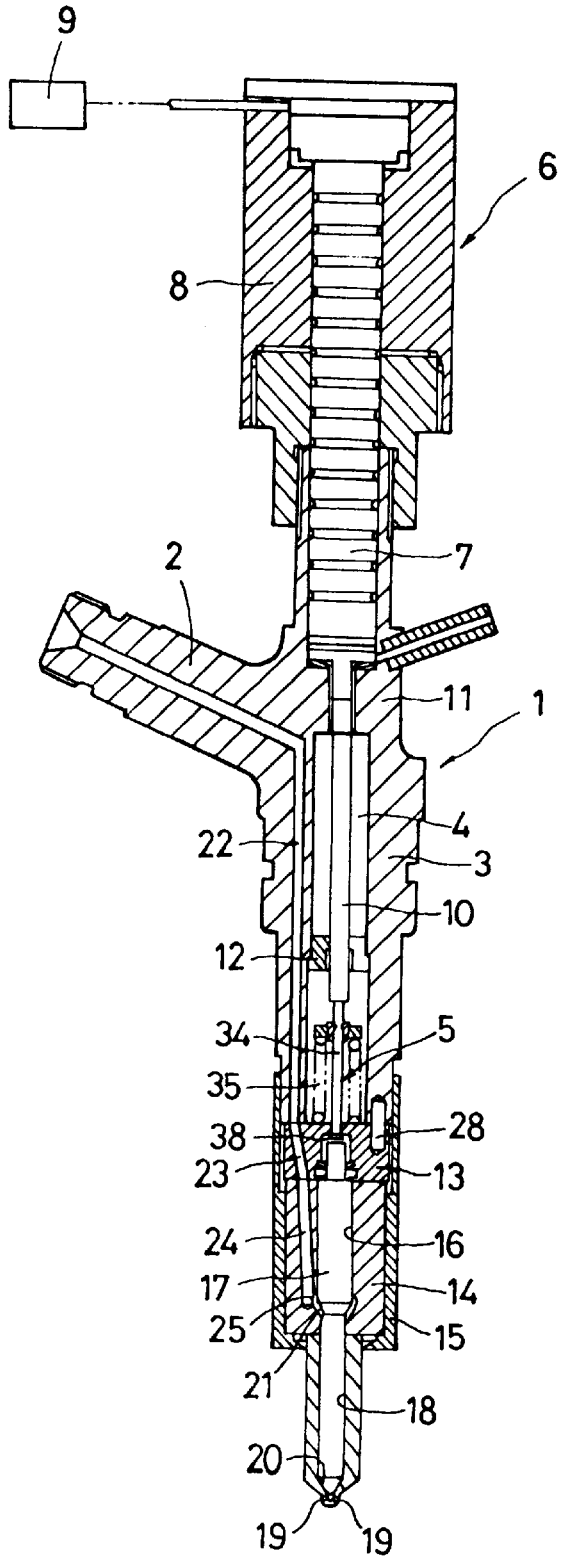
FIG. 1 is a cross section of the fuel injection device for engines as one embodiment of this invention.

This fuel injection device is applied to a common rail injection system or an accumulator injection system (not shown). Fuel, which is supplied from the fuel injection pump through a common passage or a pressure accumulation chamber (referred to as a common rail), is injected into each combustion chamber in the engine. First, referring to FIG. 1, a body 1 of the fuel injection device is hermetically installed in a hole (not shown) formed in a base such as a cylinder head with a sealing member interposed. The device body 1 has a nozzle hermetically formed at the lower end thereof.

A fuel inlet portion 2 is formed at a shoulder part of the device body 1 and a hollow portion 4 is formed in a central body portion 3 of the device body 1 along the axis. In the hollow portion 4 is installed an open-close valve 5 described later that opens and closes an exhaust passage and is driven by an actuator 6 situated above the central body portion 3. The actuator 6 is made of a piezoelectric element 7 that is installed in the device body 1 by screwing a fixing cap 8 over the central body portion 3. The piezoelectric element 7 is activated by a control signal from a control unit 9 to open the open-close valve 5. An output shaft 10 of the actuator 6 extends from the piezoelectric element 7 into the hollow portion 4 and is slidably guided by a guide portion 11 formed in the central body portion 3 and having a reduced diameter and by a guide piece 12 installed in the hollow portion 4 on the nozzle end side of the guide portion 11. The output shaft 10 can be reciprocally moved in the axial direction at high speed by the operation of the piezoelectric element 7 of the actuator 6.

The control member 13 is clamped between the central body portion 3 and a nozzle body 14. A fixing cap 15 fitted over the nozzle body 14 is screwed over a threaded part of the central body portion 3 to secure both the control member 13 and the nozzle body 14 to the central body portion 3, with these parts together forming a part of the device body 1. In the nozzle body 14 is formed a hole 16, in which a needle valve 17 is slidably inserted with a clearance 18 therebetween. The clearance 18 formed around the needle valve 17 forms a passage for high pressure fuel. The nozzle body 14 is formed at its end with nozzle holes 19 through which fuel is injected into a combustion chamber of the engine. The front end of the needle valve 17 is tapered so that as the needle valve 17 is moved axially, its tapered front end contacts or parts from a tapered surface 20 formed at the front end of the hole 16 in the nozzle body 14 to cut off or permit a flow of fuel to be injected from the nozzle holes 19. A tapered surface 21 formed at the middle of the needle valve 17 constitutes a pressure receiving portion that receives a fuel pressure acting in a direction that opens the nozzle holes 19. When the needle valve 17 lifts and parts from the tapered surface 20, a high pressure fuel is injected from the nozzle holes 19 into the combustion chamber. When the needle valve 17 moves down and comes into contact with the tapered surface 20, the fuel flow is interrupted, stopping the fuel injection.

The fuel supplied from the common rail (not shown), a high pressure fuel source, to the fuel inlet portion 2 flows through a fuel passage 22 in the device body 1 and a fuel passage 23 in the control member 13 and then through a fuel passage 24 formed in the nozzle body 14 to reach a fuel reservoir 25, in which the tapered surface 21 as the pressure receiving portion is exposed. The fuel that has entered into the fuel reservoir 25 moves through the clearance 18 formed around the needle valve 17 and is injected from the nozzle holes 19 when the needle valve 17 opens.

Figure 2:
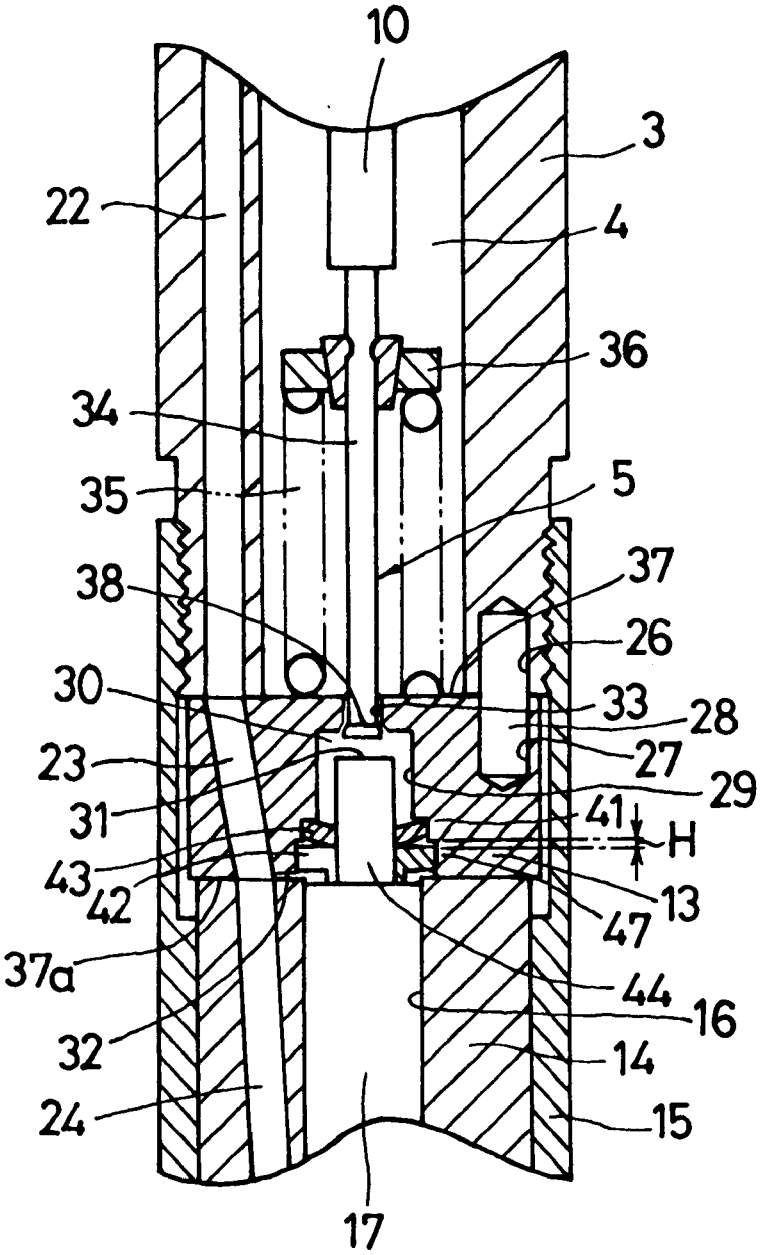
FIG. 2 is an enlarged cross section showing an essential part of the fuel injection device of FIG. 1.

As also shown in FIG. 2, a pin 28 is fitted in a pin hole 26 formed in the device body 1 and in a pin hole 27 formed in the control member 13, the both pin holes located at an off-centered position, to prevent the positional deviation of the control member 13 relative to the central body portion 3. The control member 13 is formed with a hole 29 that opens into the nozzle body 14. In the hole 29 is exposed an end of the needle valve 17, described later, which works as a pressure receiving surface 31 for receiving the fuel pressure. The hole 29 and the pressure receiving surface 31 together form a balance chamber 30. An end face 37*a* of the control member 13 on the nozzle body 14 side is formed with a supply passage 32 that communicates with the fuel passage 23 and extends radially toward the center. The supply passage 32 communicates with the balance chamber 30 and supplies a high fuel pressure into the balance chamber 30. At the center of the control member 13 there is formed an axially piercing exhaust passage 33, which opens at one end to the balance chamber 30 and at the other to the hollow portion 4 in the central body portion 3.

The open-close valve 5 has a valve stem 34 integrally connected with the output shaft 10 of the actuator 6 and a return spring 35 that urges the valve stem 34 in a direction that closes the open-close valve 5. The valve stem 34 constitutes a valve stem portion of this invention. The return spring 35 engages at one end with a spring retainer 36 secured to the valve stem 34 and at the other end with an upper end face 37 of the control member 13. The return spring 35, because it is installed in a compressed state, always urges the valve stem 34 upwardly.

Figure 4:
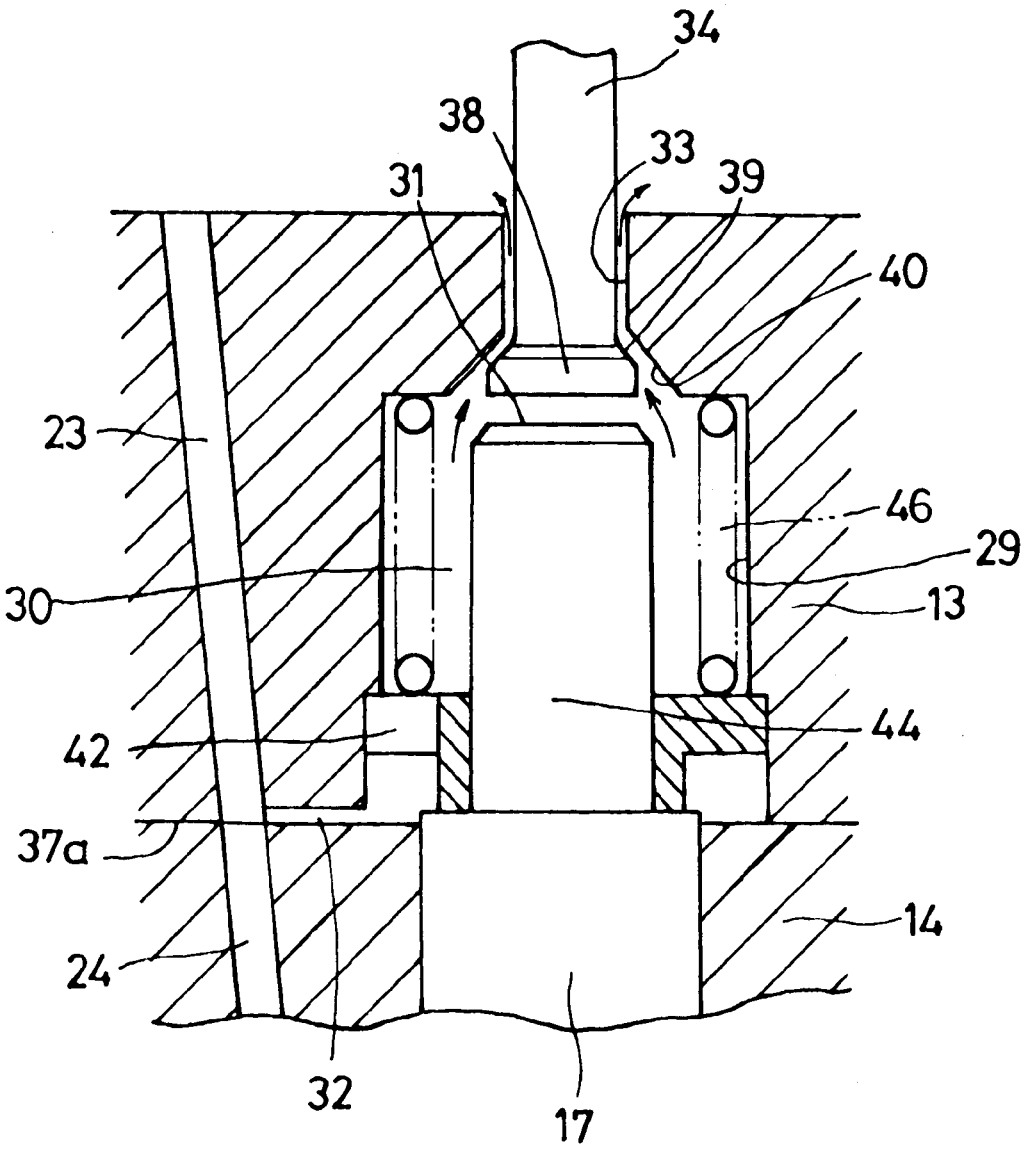
FIG. 4 is a cross section showing an open-close valve in the fuel injection device of FIG. 3 in an open state.

The valve stem 34 is inserted, with a small clearance, through the exhaust passage 33 formed in the control member 13 and extends into the balance chamber 30. The valve stem 34 has a valve head 38 at its end that opens and closes the exhaust passage 33. The essential part of the structure of the fuel injection device shown in FIG. 4 is similar to that shown in FIG. 2, except that it employs a different type of spring as a means to urge the needle valve 17 in a direction that stops the fuel injection. The detail of the open-close valve 5 will therefore be explained by referring to FIG. 4. The valve head 38 has a valve face 39, a conically tapered surface, which is so shaped as to snugly engage with a conical valve seat 40 formed at a port of the exhaust passage 33 on the balance chamber 30 side. When the piezoelectric element 7 is not energized, the open-close valve 5 is closed by a spring force of the return spring 35. In this condition, the valve face 39 of the valve head 38 is seated on the valve seat 40 in a surface contacting state to close the exhaust passage 33. When the piezoelectric element 7 is energized, the valve stem 34 of the open-close valve 5 is pushed down against the force of the return spring 35. At this time, the valve face 39 of the valve head 38 parts from the valve seat 40 to open the port of the exhaust passage 33 on the balance chamber 30 side, allowing a small fuel flow in the direction of arrow, releasing the fuel pressure in the balance chamber 30 into the hollow portion 4 through the clearance between the exhaust passage 33 and the valve stem 34.

Between a stepped portion 41 of the hole 29 and a spring retainer 42 secured to a shaft end 44 of the needle valve 17 is interposed in a compressed state a coned disc spring 43 as a return spring. The coned disc spring 43 urges the needle valve 17 in a closing direction that interrupts the flow of fuel through the nozzle holes 19. To ensure that the fuel pressure from the supply passage 32 reaches the balance chamber 30, the spring retainer 42 and the dish spring 43 are both formed with appropriate holes (not shown). A valve lift is decided by the balance of three force; the force acting on the pressure receiving surface 31 of the needle valve 17, the return force of coned disk spring 43 and the force acting on the tapered surface 21 of the needle valve 17. At a stepped portion 47 formed in the control member 13 to accommodate the spring retainer 42 there is a space H between the closing state and the opening state of the needle valve 17. So, the needle valve 17 can move in the valve open-close direction in a range of distance H.

An effective opening area provided by the valve face 39 of the valve head 38 parting from the valve seat 40 when the open-close valve 5 opens the exhaust passage 33 is set smaller than the cross-sectional area of the clearance between the exhaust passage 33 and the valve stem 34 in most of the operation range of the open-close valve 5. Therefore, the opening degree of the open-close valve 5 determines the extent to which the fuel pressure in the balance chamber 30 decreases.

This embodiment with the above construction operates as follows.

When the piezoelectric element 7 is not energized, the return spring 35 urges the valve stem 34 upward through the spring retainer 36 causing the valve face 39 of the valve head 38 to engage with the valve seat 40, closing the exhaust passage 33 by the open-close valve 5, as shown in FIG. 2. In this condition, the high pressure fuel from the common rail is supplied through the fuel inlet portion 2 and the fuel passages 22, 23, 24 to the fuel reservoir 25. The fuel supplied into the fuel reservoir 25 acts on the tapered surface 21 of the needle valve 17 to urge it to lift. The fuel further advances and fills into the clearance 18 between the nozzle body 14 and the needle valve 17. The fuel pressure is also supplied through the supply passage 32 into the balance chamber 30 and acts on the pressure receiving surface 31 of the needle valve 17. At this time, the combination of a force produced by the fuel pressure acting on the pressure receiving surface 31 to urge the needle valve 17 to close and a return force of the coned disc spring 43 is greater than a force produced by the fuel pressure acting on the tapered surface 21 as the pressure receiving surface to urge the needle valve 17 to open. Thus, the needle valve 17 closes and stops the fuel injection from the nozzle holes 19.

When the piezoelectric element 7 is driven by the control unit 9, the valve stem 34 is pushed down against the force of the compressed return spring 35 causing the valve face 39 of the valve head 38 to part from the valve seat 40, with the result that the open-close valve 5 opens the exhaust passage 33. The supply passage 32 functions as a throttle and the amount of fuel flowing out of the exhaust passage 33 is larger than the amount of fuel flowing in through the supply passage 32. Hence, when the exhaust passage 33 is opened, the fuel pressure in the balance chamber 30 is released into the hollow portion 4. When the fuel pressure in the balance chamber 30 is released, the force produced by the fuel pressure acting on the tapered surface 21 to urge the needle valve 17 to open overcomes the combination of the force produced by the fuel pressure acting on the pressure receiving surface 31 at the top of the needle valve 17 to urge the needle valve 17 to close and the return force of the disc spring 43, thus lifting the needle valve 17 to perform fuel injection from the nozzle holes 19 into the combustion chamber. Because the effective opening area of the exhaust passage 33 opened by the open-close valve 5 is smaller than the cross-sectional area of any exhaust passage downstream of the balance chamber 30, the opening degree of the open-close valve 5 determines the magnitude of the fuel pressure in the balance chamber 30.

When an electric current supply to the piezoelectric element 7 from the control unit 9 is cut off, the return spring 35 pushes up the valve stem 34 to close the open-close valve 5. The fuel pressure in the balance chamber 30 is restored by the fuel supply from the supply passage 32 causing the needle valve 17 to stop the fuel injection. The recovered fuel pressure acts on the valve head 38 to urge, in combination with the return spring 35, the valve face 39 to press against the valve seat 40. Hence, the higher the fuel pressure in the balance chamber 30, the greater the closing force of the open-close valve 5 and the more effectively the leakage of fuel through the open-close valve 5 can be blocked.

Figure 3:
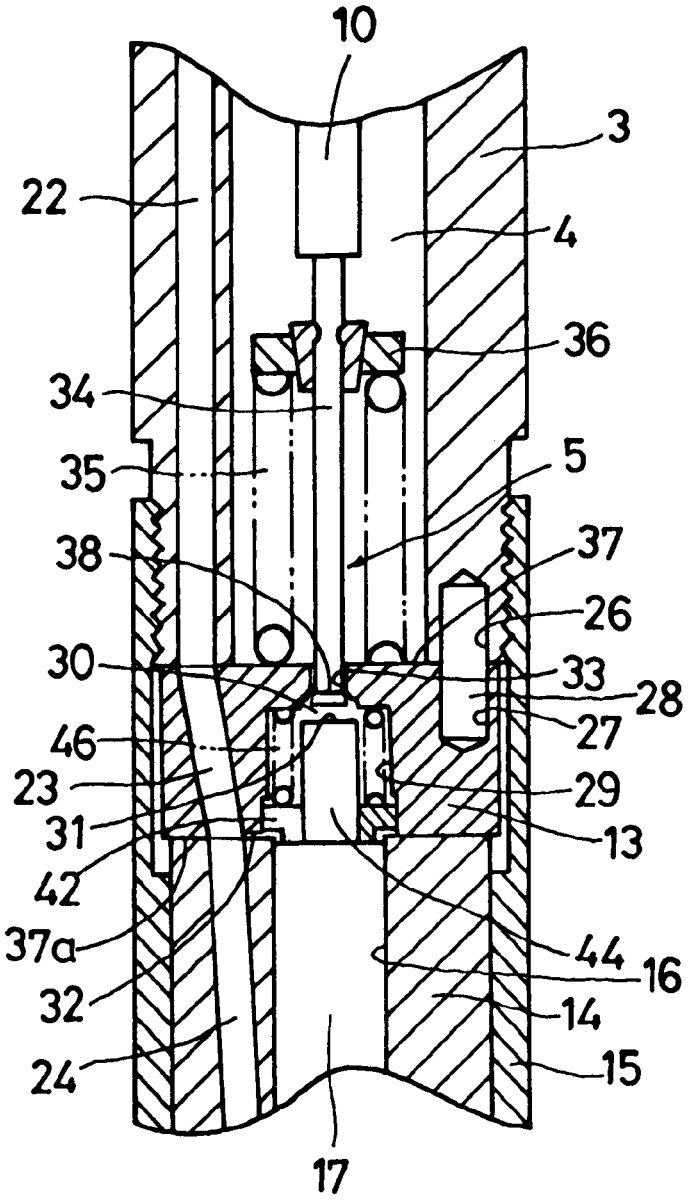
FIG. 3 is an enlarged cross section showing an essential part of the fuel injection device as another embodiment of this invention.

An embodiment shown in FIG. 3 and 4 employs a coil spring 46 instead of the coned disc spring as the return spring that urges the open-close valve 5 to close. In the embodiment shown in FIG. 3, parts identical with those of the first embodiment in FIG. 2 are assigned like reference numbers and their detailed descriptions are not repeated. In the embodiment of FIG. 3, the coil spring 46 is installed compressed in the balance chamber 30 with one end contacting the spring retainer 42 and the other contacting the top inner surface of the hole 29. The coil spring 46 has the same return spring function as the coned disc spring 43. Because the top inner surface of the hole 29 can be used as it is for the engagement of the coil spring 46, there is no need to form the stepped portion 41 in the hole 29 for holding the coned disc spring 43 as is required in the first embodiment of FIG. 1 and 2 where the coned disc spring 43 is used.

Figure 5:
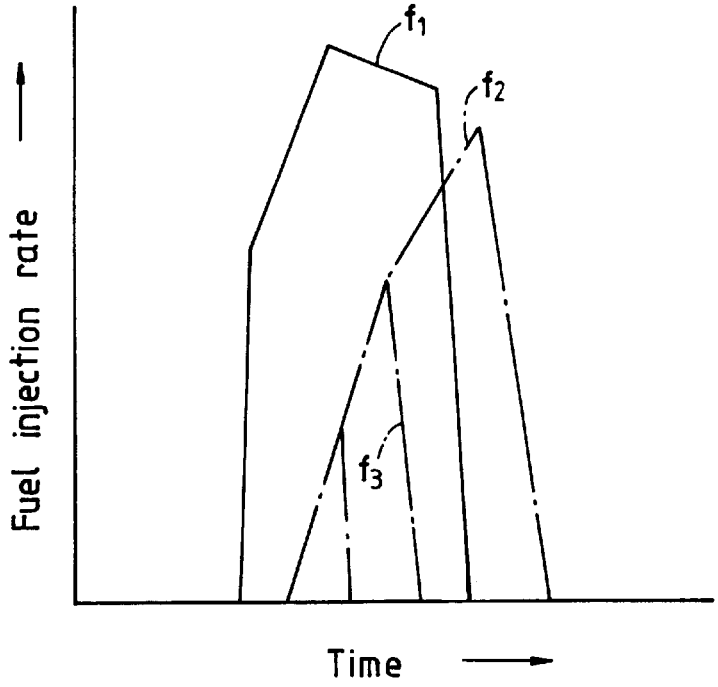
FIG. 5 is a graph showing a fuel injection rate during the fuel injection cycle.

FIG. 5 shows fuel injection rates in fuel injection cycles measured by a known injection rate meter. A curve $f_1$ represents a change in the fuel injection rate of the needle valve 17 during a fuel injection cycle where a high voltage is supplied to the piezoelectric element 7. The graph shows that the fuel injection rate rapidly increases once the voltage is applied. When the piezoelectric element 7 is applied with a low voltage, the fuel injection rate increases moderately after the voltage application, as shown by a curve $f_2$. In the case of the curve $f_2$, if the voltage application to the piezoelectric element 7 is stopped after a short application, the fuel injection is interrupted at a low injection rate as shown by a curve $f_3$. That is, the fuel injection rate can be controlled easily by controlling the timing, interval and magnitude of the voltage application to the piezoelectric element 7 according to the operating condition of the engine such as load.

Figure 6:
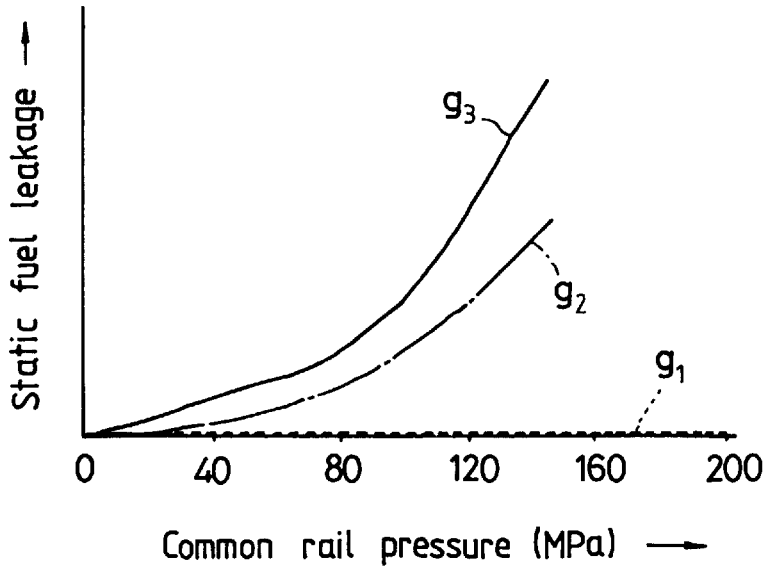
FIG. 6 is a graph showing a static fuel leakage with respect to a common rail pressure.

FIG. 6 shows a static fuel leakage of the fuel injection device of this invention when the common rail pressure is changed, as compared with fuel leakages of other fuel injection devices employing different types of open-close valve than that of this invention for releasing the fuel pressure from the balance chamber. As shown by a curve $g_2$ and a curve $g_3$, which represent the leakages of fuel injection devices using a two-way valve and a three-way valve, respectively, as the control valve for releasing the fuel pressure from the balance chamber, the static fuel leakage increases as the common rail pressure increases. With the fuel injection device of this invention, however, when the open-close valve 5 is closed, the fuel pressure in the balance chamber 30 acts in a direction of closing the valve, so that fuel does not leak through the exhaust passage 33 even at high fuel pressure. As shown by a line $g_1$, the static fuel leakage of this invention can be kept at zero up to the common rail pressure of 200 MPa.

Figure 7:
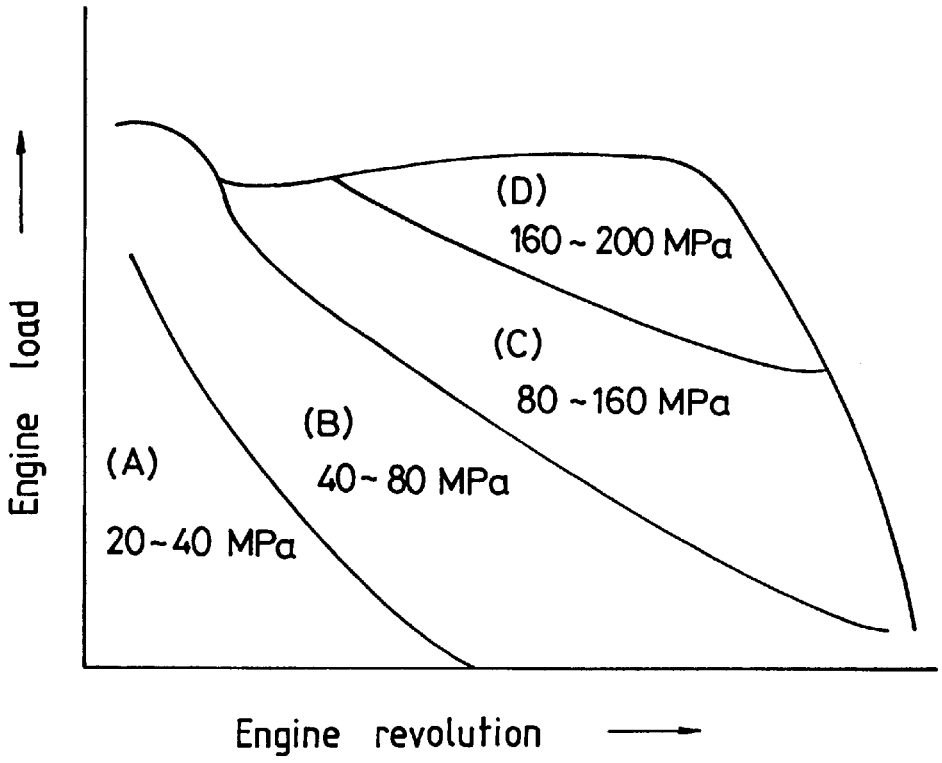
FIG. 7 is a graph showing fuel injection pressures necessary for regions defined by an engine revolution and an engine load.
Figure 8:
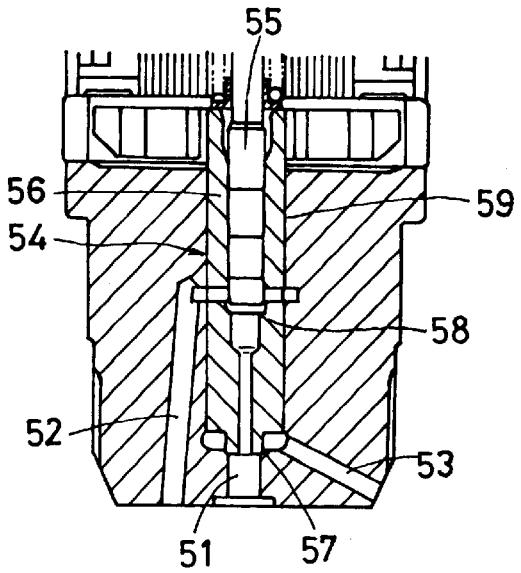
FIG. 8 (PRIOR ART)
FIG. 8 is an enlarged cross section showing an essential part of a conventional fuel injection device in one operated state.
Figure 9:
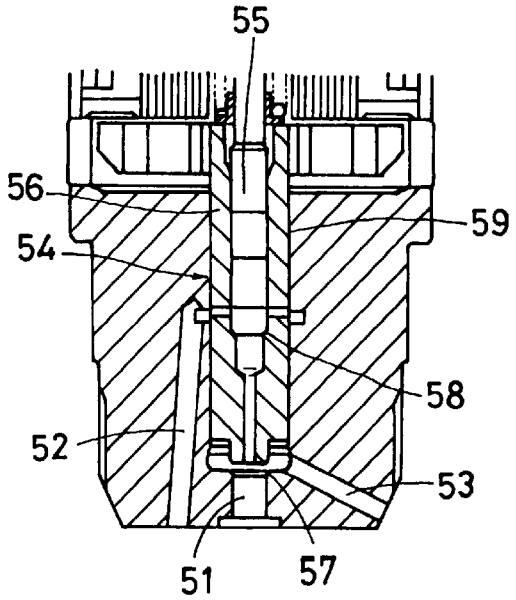
FIG. 9 (PRIOR ART)
FIG. 9 is an enlarged cross section showing the essential part of the conventional fuel injection device of FIG. 8 in another operated state.
Figure 10:
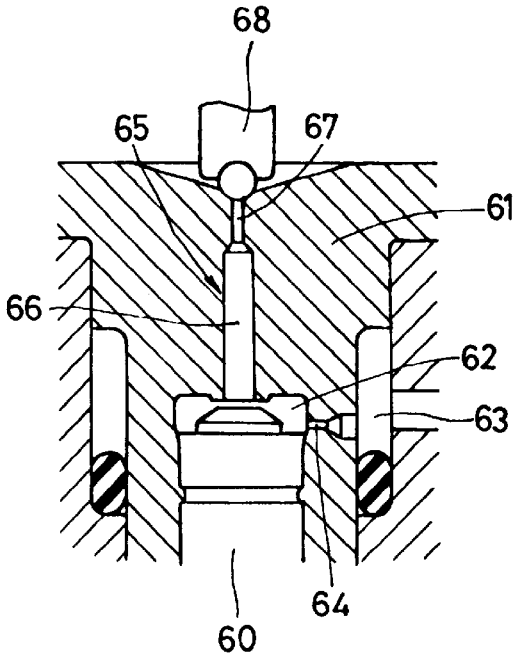
FIG. 10 (PRIOR ART)
FIG. 10 is an enlarged cross section showing an essential part of another conventional fuel injection device.
Figure 11:
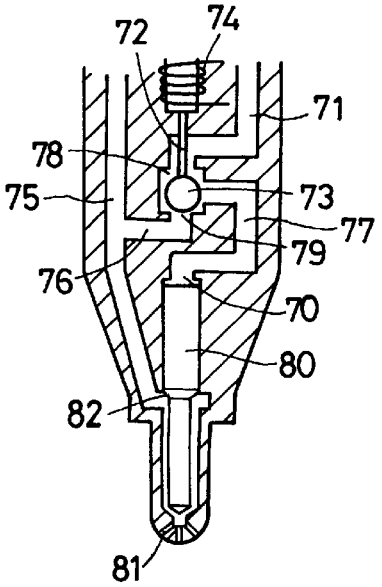
FIG. 11 (PRIOR ART)
FIG. 11 is a schematic cross section showing still another conventional fuel injection device.

With the fuel injection device of this invention the pressure in the balance chamber 30 acts to close the open-close valve 5. Hence, during a high pressure injection, opening the open-close valve 5 requires a large consumption of force for activating the actuator 6 (power consumption in the case of a piezoelectric element). It is noted, however, that the engine operating conditions requiring high pressure injection of fuel are the ones where the engine is running at high revolution speeds and with high loads, as represented by operating ranges (C) and (D) in FIG. 7. In such operating ranges, the engine generates a large amount of electricity and thus even high power consumption does not shorten the battery life.

What is claimed is:

1. A fuel injection device for engines comprising:

a device body having nozzle holes for injecting fuel;

a needle valve reciprocating in a hollow portion in the device body to open and close the nozzle holes at one end thereof;

a balance chamber in which is exposed the other end of the needle valve that forms a pressure receiving surface to receive a fuel pressure to control the lift of the needle valve;

a supply passage to supply the fuel pressure to the balance chamber;

an exhaust passage to release the fuel pressure from the balance chamber;

an open-close valve to open and close the exhaust passage; and an actuator to drive the open-close valve;

wherein the open-close valve comprises a valve stem piercing through the exhaust passage and extending into the balance chamber and a valve head provided at an end of the valve stem, wherein the valve head has a valve face that, when the valve is closed, contacts a valve seat formed at an inlet port of the exhaust passage, and wherein the actuator drives the open-close valve to adjust the lift of the open-close valve and an effective opening area of the exhaust passage so as to set a fuel injection rate and lift speed of the needle valve.

2. A fuel injection device for engines according to claim 1, wherein the balance chamber is formed by a hole in a control member constituting a part of the device body and by the other end of the needle valve, and the exhaust passage is formed in the control member.

3. A fuel injection device for engines according to claim 2, wherein a return spring that urges the needle valve in a direction of closing the nozzle holes is installed in the balance chamber.

4. A fuel injection device for engines according to claim 3, wherein the return spring is any one of a coned disc spring and a coil spring.

5. A fuel injection device for engines according to claim 2, wherein the device body has a nozzle body having the nozzle holes and accommodating the needle valve reciprocatingly movable therein and the control member engaging the nozzle body, and the supply passage is formed between the nozzle body and the control member.

6. A fuel injection device for engines according to claim 1, wherein the open-close valve is formed of a poppet valve whose valve face is a convex tapered surface which, when the open-close valve is closed, is brought into close contact with a concave tapered surface of the valve seat.

7. A fuel injection device for engines according to claim 1, wherein the actuator is formed of a piezoelectric element.

* * * * *